US005775943A

United States Patent [19]

McElhone

[11] Patent Number: 5,775,943

[45] Date of Patent: Jul. 7, 1998

[54] STANDBY RECEPTACLES

[76] Inventor: James J. McElhone, 8 S. 13th St., Darby, Pa. 19023

[21] Appl. No.: 764,986

[22] Filed: Dec. 13, 1996

[51] Int. Cl.[6] ..... H01R 13/60

[52] U.S. Cl. ..... 439/528

[58] Field of Search ..... 439/528

[56] References Cited

U.S. PATENT DOCUMENTS 3,331,915 7/1967 Lucci ..... 439/528

4,921,444 5/1990 Cama ..... 439/528

*Primary Examiner*—Gary F. Paumen

*Attorney, Agent, or Firm*—Stephen G. Stanton; John S. Munday; Munday and Stanton

[57] ABSTRACT

A device useful with electrical appliances having a plug for insertion in an electrical power outlet. In addition to an electrical power outlet having a receptacle for transmitting power to an electrical plug, the device includes a standby receptacle having openings for receiving an electrical cord plug. The standby receptacle is insulated to prevent transmission of electrical energy to the electrical cord plug when it is inserted therein. The device is fixedly mounted on the standby receptacle at a point proximate the electrical power outlet. The electrical cord plug may include two conductive prongs extending therefrom for insertion into the electrical power outlet, or it may have a third prong as a ground. The standby receptacle thus has two prong receptacles or three prong receptacles for receipt of the corresponding prongs. The device may be mounted on a face plate associated with the electrical power outlet, such that mounting allows for removable or non removable mounting of the standby receptacle to the face plate. In a preferred embodiment, the standby receptacle is integral with the face plate. Whereby the standby receptacle is positioned on the face plate to permit unimpeded connection of any electrical cord plug to the electrical power outlet.

13 Claims, 1 Drawing Sheet

STANDBY RECEPTACLES

FIELD OF THE INVENTION

The present invention relates to a standby electrical receptacle. More particularly the invention relates to a fixedly mounted receptacle that is suitable for storing electrical plugs, such as from appliances and the like, when it is desired that the plug be disengaged from electrical power but remain close to an electrical outlet for convenient use.

BACKGROUND OF THE INVENTION

In many homes and businesses, appliances such as coffee pots, toasters, microwaves and televisions are commonly used intermittently, so that it is not necessary to have the appliance plugged into an outlet all the time. In some instances, there are only a limited number of electrical outlet receptacles available and more plugs are used at that location than can be accommodated by the electrical service. This is particularly true when the plugs and their attendant appliances are only used occasionally.

It has been proposed to use various devices that increase the number of outlet receptacles available, such as by inserting a device into one outlet receptacle that itself contains a plurality of receptacles. This permits the use of a larger number of appliances, and often times leads to overload conditions, often causing the fuse or circuit breaker to terminate electrical service. In some cases, the overload is so severe that an electrical fire or other overheating occurs. This is dangerous, and occurs often in older buildings which were constructed in times when the number and quality of electrical products was substantially less than now.

Some prior art devices have addressed the general problem of what to do with an electrical cord plug when it is not in use. Wales U.S. Pat. No. 2,721,717 relates to an electrical cord holder that is mounted on the cord using a permanent magnet in the plug itself, whereby the plug end attaches to the appliance. It is intended for use when the toaster or other appliance is put away when not in use. Jackson U.S. Pat. No. 2,838,265 discloses an annular plate, which may form an outer part of a clothes drying cabinet wall that grips the pins frictionally due to the use of arcuate walls. This does not directly relate to attachment at the power outlet.

Singh U.S. Pat. No. 4,076,360 teaches the use of an externally threaded sleeve type device that surrounds at least part of an electrical connector device. Both a cap 10 used during storage and a cover 13 used during insertion of the plug are threadedly attached to the outlet cover for the purpose of covering and denying access to the outlet power other than when threaded on to the outlet. This does not provide for a storage place for the outlet plug but does suggest that the cap 10 can be stored on a dummy or standby threaded ring as in 7*c* of FIG. 2.

Lauben et al U.S. Pat. No. 4,079,344 provides for a portable grounding device that plugs into conventional wall receptacles and affords a ground protection when a cord in plugged into the receptacle. Dummy prongs are used to insert into the other socket of the wall receptacle but there is no suggestion of an ability to access these dummy prongs, nor that they can be used to store a plug.

Finally Maki U.S. Pat. No. 5,308,253 discloses a holder for securing receptacle plugs at selected locations. In this patent, the extension cord is removed from whatever it is used with, then placed in a storage holder. The holder does not relate at all to the face place or wall plate, nor is any suggestion present that would lead one to modify the Maki design to consider the wall plate.

In summary, the prior art does not suggest any device that may be used as a standby receptacle plugs that replicate the active plug in size and shape, and is attached to the same face plate covering the active receptacle.

Accordingly, it is an object of the present invention to provide a device for holding an appliance cord plug or other similar device when the plug is not in use.

Another object of this invention is to provide a device which permits the use of a large number of electrical appliances at one electrical receptacle without overloading the circuit.

Yet another object of the present invention is to provide a device capable of non-conductively storing the plug end of an electrical cord at a point proximate an electrically active receptacle without any possibility of inadvertent overload of the receptacle.

Other objects will appear hereinafter.

SUMMARY OF THE INVENTION

It has now been discovered that the above and other objects of the present invention may be accomplished in the following manner. Specifically, the present invention provides a device useful with electrical appliances having a plug for insertion in an electrical power outlet.

The device of this invention includes a standby receptacle having openings for receiving an electrical cord plug. The standby receptacle is insulated or is otherwise non-conductive so as to prevent transmission of electrical current to the electrical cord plug when it is inserted therein.

The device is fixedly mounted on the standby receptacle at a point proximate the electrical power outlet. By being fixed to the outlet or close thereby, it provides easy access that is always there as needed. In the preferred embodiment, there are two standby receptacles that are permanently mounted on a bracket. The bracket is then attached to the face plate of the outlet via the already existing mounting means, such as a simple screw fitting the center of the outlet. Alternatively, the standby receptacle or receptacles may be glued or otherwise permanently attached to a point proximate the outlet, such as directly on the face plate. In any case, the standby receptacle is positioned on the face plate to permit unimpeded connection of any electrical cord plug to the electrical outlet.

The electrical cord plug may include two conductive prongs extending therefrom for inserting into the electrical power outlet, or it may have a third receptacle to accommodate the ground prong. The receptacle may also have two or three prong accepting openings, since it is not necessary to ground a cord that is not connected to electrical current.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
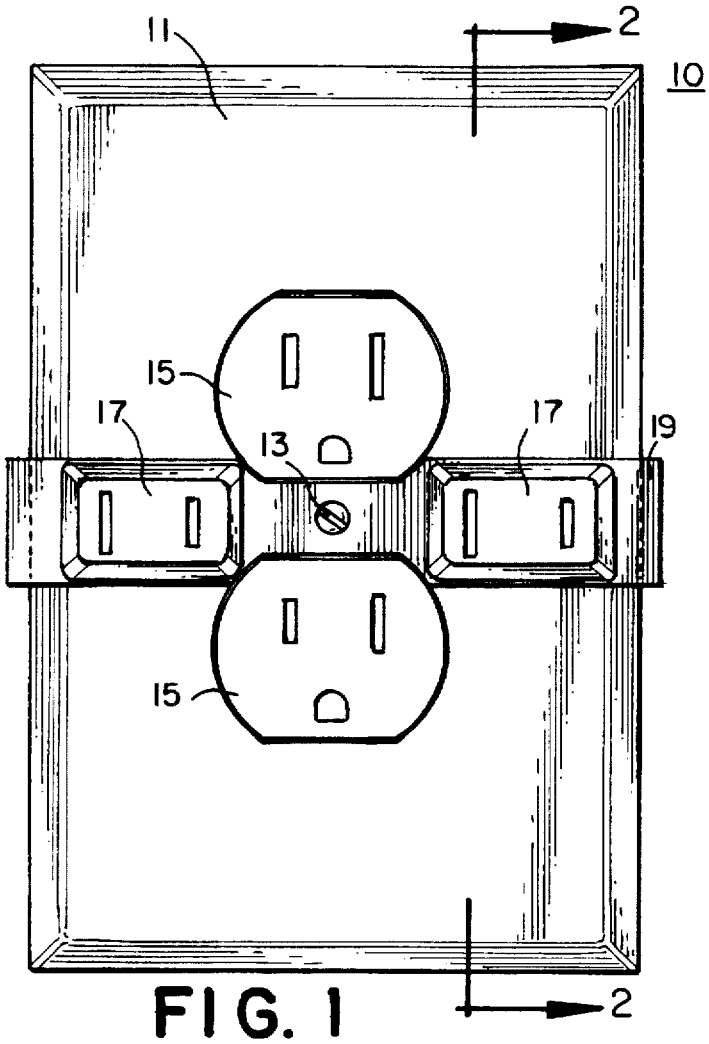
FIG. 1 is front elevational view of the preferred device of this invention.

As shown in FIG. 1, a device 10, generally, is provided for use with face plate 11 associated with said electrical power outlet via face plate mounting screw 13. A pair of receptacles 15 are provided for transmitting power to an electrical plug. This is a conventional electrical outlet found in most homes and businesses, and is provided with two receptacles 15 so that the appropriate number of appliances may be used at that outlet. Designers and builders of homes and offices will provide other similar outlets at various locations within the facility.

The conventional outlet shown in FIG. 1 is sometimes located in a place where it may be desirable to use more than two appliances, lamps, radios or the like, although not more than two devices at one time. As has been mentioned, it is possible to insert a plug that includes a larger number of active outlets. Doing this has caused many serious problems, especially when a number of high energy appliances are used simultaneously. The alternative has been to unplug unused appliances, which is the safe thing to do, but then the cord plug becomes a problem. It is not always convenient to remove the toaster or the like, such as by putting it in a cabinet, for example, only to have to get it out at the next meal.

To remedy this deficiency and to improve the safety of normal appliance use, the present invention provides a standby receptacle 17 for receiving an electrical cord plug. Standby receptacle 17 appears to be similar to the ordinary receptacle 15, shown in FIG. 1 with two prong receptacles and, in a different embodiment in FIG. 4, as a three prong receptacle 27. The third prong receptacle 31 is positioned and sized to accept the ground prong found on more modern or higher current drawing appliances. In both cases, standby receptacles 17 and 27 are insulated and are not connected to any electrical energy source.

There is no electrical connection to standby receptacles 17 or 27. The advantage of this feature is that there is no problem for a plug to be inserted into the standby plug 17 (or 27) since the appliance will not draw any current and it is as safe as if it were in a drawer or cabinet for storage. In addition, the prongs of the plug to be inserted into the receptacles 15 for use are not subject to bending or other damage since they are safely inside standby receptacle 17 when not in use.

Figure 2:
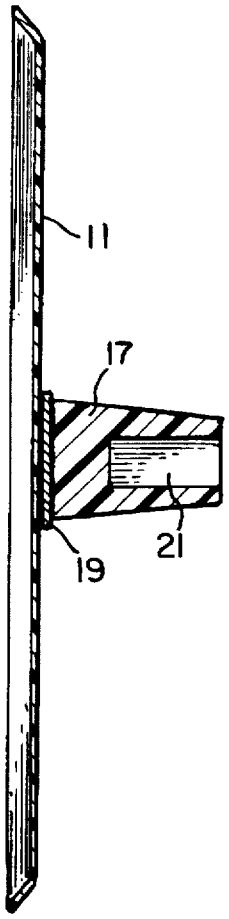
FIG. 2 is a side elevational view taken along the line 2, 2 of FIG. 1.

FIG. 2, showing a section of the device of FIG. 1, clearly illustrates that receptacle 21 is not connected to anything, and thus no electrical conduction can take place. Standby receptacle 17 is made of rubber or other non conductive material and the inside of receptacle 21 does not contact bracket 19, thus permitting bracket 19 to be made from metal as well as from non conductive plastics and the like.

FIG. 1 also illustrates another feature of the present invention. Bracket 19 is sized and shaped to conform to and move around the active receptacles 15 to permit a flush and non-movable yet supported positioning of the bracket 19. Thus the appearance of the bracket 19 and standby receptacles 17 do not detract from the overall appearance of the outlet but rather blend in or even add to the design by maintaining symmetry and balance.

Another safety consideration involves the use of protective covering plates for active outlets. When a homeowner is concerned that a child may, out of curiosity or misadventure, insert a metal object into an active receptacle, covers are provided so that the child will be protected. With the present invention, the standby receptacles 17 are not electrically active and the child cannot be harmed. In addition, the cover may be removed by the parent and stored on the standby receptacle 17 when the plug is inserted into an active receptacle 15 for use of the appliance.

Figure 3:
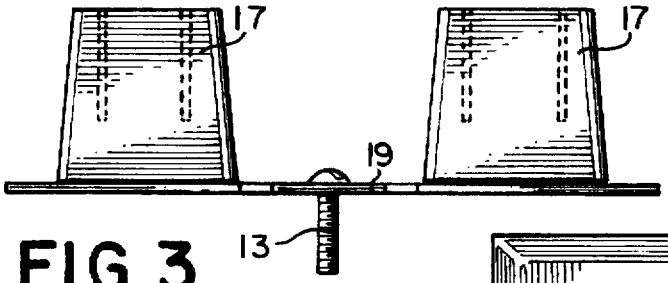
FIG. 3 is side elevational view of the detachable portion of the device of this invention, shown detached from an electrical outlet.
Figure 4:
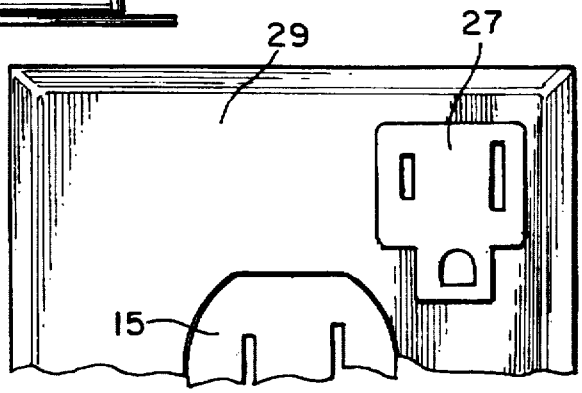
FIG. 4 is a front elevational view of an alternative embodiment in which the device of this invention is not removable from the electrical outlet plate.

Standby receptacles 17 are shown in FIG. 1 as being attached to face place 11 via bracket 19. Both standby receptacles 17 are fixedly fastened to bracket 19, such as by glue, adhesive or other fasteners. Bracket 19 is attached to face plate 11 via face plate mounting screw 13, as is shown in FIG. 3. Alternatively, the standby receptacle 27 can be non-removably mounted to face place 19 as illustrated in FIG. 4. In either case, the standby receptacle 17 or 27 will not be misplaced, lost or damaged as it is fixed in place. In the preferred embodiment, shown in FIGS. 1–3, it can be removed. It is also possible to place standby receptacle 17, 27 on a wall or surface proximate the active receptacle 15 apart from face plate 11.

While particular embodiments of the present invention have been illustrated and described, it is not intended to limit the invention, except as defined by the following claims.

I claim:

1. A device for use with electrical appliances having an electrical plug with conductive prongs for insertion in an electrical power outlet, comprising:

an electrical power outlet having a receptacle for transmitting electrical power to the electrical plug through the conductive prongs thereof;

a standby receptacle made of dielectric material and having prong receptacles for receiving the conductive prongs snugly and simultaneously, said prong receptacles preventing transmission of electrical power to the electrical plug when inserted therein; and means for readily removably mounting said standby receptacle to a point proximate the electrical power outlet.

2. The device of claim 1, wherein said mounting means is mounted on a face plate associated with said electrical power outlet.

3. The device of claim 2, whereby said mounting means removably mounts said standby receptacle on said face plate.

4. The device of claim 2, whereby said standby receptacle is positioned on the face plate to permit unimpeded connection of any electrical cord plug to said electrical power outlet.

5. A device for use with electrical appliances having an electrical plug with conductive prongs for insertion in an electrical power outlet, comprising:

an electrical power outlet having a receptacle for transmitting electrical power to the electrical plug through the conductive prongs thereof;

a standby receptacle made of dielectric material and having prong receptacles for receiving the conductive prongs snugly and simultaneously, said prong receptacles preventing transmission of electrical power to the electrical plug when inserted therein, said standby receptacle being nonremovably mounted to a face plate at a point proximate said electrical power outlet.

6. The device of claim 5, whereby said standby receptacle is integral with the face plate.

7. The device of claim 5, whereby said standby receptacle is positioned on the face plate to permit unimpeded connection of any electrical cord plug to said electrical power outlet.

8. In a device for use with electrical appliances having an electrical plug with conductive prongs for insertion in an electrical power outlet having a receptacle for transferring electrical power to the electrical plug through the conductive prongs thereof, the improvement comprising:

a standby receptacle made of dielectric material and having prong receptacles for receiving the conductive prongs snugly and simultaneously, said prong receptacles preventing transmission of electrical power to the electrical plug when inserted therein; and means for readily removably mounting said standby receptacle to a point proximate the electrical power outlet.

9. The device of claim 8, wherein said mounting means is mounted on a face plate associated with said electrical power outlet.

10. The device of claim 9, whereby said mounting means removably mounts said standby receptacle on said face plate.

11. The device of claim 9, whereby said standby receptacle is positioned on the face plate to permit unimpeded connection of any electrical cord plug to the electrical power outlet.

12. In a device for use with electrical appliances having an electrical plug with conductive prongs for insertion in an electrical power outlet having a receptacle for transferring electrical power to the electrical plug through the conductive prongs thereof, the improvement comprising:

a standby receptacle made of dielectric material and having prong receptacles for receiving the conductive prongs snugly and simultaneously, said prong receptacles preventing transmission of electrical power to the electrical plug when inserted therein, said standby receptacle being nonremovably mounted to a face plate at a point proximate the electrical power outlet.

13. The device of claim 12, whereby said standby receptacle is integral with the face plate.

* * * * *